United States Patent [19]

Kawai et al.

[11] Patent Number: 4,551,868

[45] Date of Patent: Nov. 12, 1985

[54] WASHING DEVICE FOR PARTS OF BODY

[75] Inventors: Shinji Kawai, Toyota; Yuji Yamaguchi, Anjo; Koichi Suzuki, Chiryu; Hisanobu Takeda, Aichi, all of Japan

[73] Assignee: Aisin Seiki Kabushiki Kaisha, Kariya, Japan

[21] Appl. No.: 539,751

[22] Filed: Oct. 6, 1983

[30] Foreign Application Priority Data

Oct. 6, 1982 [JP] Japan ..... 57-175589

[51] Int. Cl.[4] ..... A61H 35/00

[52] U.S. Cl. ..... 4/443

[58] Field of Search ..... 4/420.1, 420.2, 420.4, 4/420.5, 443–448

[56] References Cited

U.S. PATENT DOCUMENTS

| | | | |
|---|---|---|---|
| 4,208,746 | 6/1980 | Minamoto et al. | 4/448 |
| 4,304,016 | 12/1981 | Oguma et al. | 4/448 X |
| 4,340,980 | 7/1982 | Fushimi et al. | 4/448 |
| 4,451,942 | 6/1984 | Hirano et al. | 4/448 X |

*Primary Examiner*—Charles E. Phillips

*Attorney, Agent, or Firm*—Oblon, Fisher, Spivak, McClelland & Maier

[57] ABSTRACT

In a washing device for parts of body including first cylinder means comprising a first cylinder and a first piston to be operated in the front end direction thereof by introducing pressurized water onto the first cylinder and a second piston to be operated in the front end direction thereof by introducing pressurized water into the second cylinder; pressurized water control means for selectively supplying pressurized water to both of the first and second cylinders, or to any one of them; and pressurized water supply means for supplying pressurized water to the pressurized water control means: the washing device further including sensor means for sensing that any one of the first and second pistons is operated over a predetermined operating position in the front end direction thereof. As one aspect of the invention, the pressurized water control means may be provided with a control member for controlling a supply amount pressurized water and which member is operated based on an input signal of the sensor means to supply a small amount of pressurized water. While, as another aspect of the invention, the pressurized water supply means may comprise pump means the capacity of which is variable to vary the capacity of pump means so as to reduce based on an input signal in the sensor means. The washing device of this invention can spout a weaken fountain for the purpose of bidet-washing with reliability, while it can spout an intensive fountain for the purpose of anus-washing. Also, there is no fear that a person who undergoes the anus or bidet-washing feels unpleasant.

3 Claims, 4 Drawing Figures

32"
32'
31"
S2
V1
V2
S3
S1
V
P
442
311a"
328
327
313
312
311
31
217
216
211
213
326
327a
3
32
2
331
22
1
11
12
5
51
V
S3
62
311b
61
311a
6
441
44
43
13
4
21
222
313
41
V1
V2
42
422
411
421
412
214
23
215
226
33
231
321
316
322
323
212
227

S2
V3
R
S3
53'
P
S1
DC
32"
32'

6
5'
52
F
53
P
54
12
1
22"
32
311
22
311a"
62
S3
311a
6
44'
444
443
43
42'
41'
V3
411'
4'
421

WASHING DEVICE FOR PARTS OF BODY

BACKGROUND OF THE INVENTION

1. Field of the Invention

This invention relates to an improvement of a washing device for parts of body, which is to be used in a toilet, (hereinafter, it will be merely called "a washing device").

2. Description of the Prior Art

In recent years, the aforesaid washing device has been appreciated on its utility value in a sanitary point of view and a great number of washing devices have been used.

In the conventional washing devices, a top or front end of nozzle has been projected in two steps so that in the first step, a washing function for anus is provided. In this case, a relatively intensive jet of water (or fountain) is spouted from the top end thereof. While, in the second step, another washing function for bidet is provided and in this case a relatively weaken fountain is spouted therefrom.

According to the conventional washing devices, as described above, the top end of nozzle is projected in two steps and in the respective steps, an intensive washing fountain and a weaken washing fountain are jet or spouted from the top end thereof for the aforesaid anus-washing and bidet-washing, respectively.

Therefore, in the aforesaid conventional washing devices, for example, if a switch for the anus-washing is turned "ON" at the time when the bidet-washing is effected, an intensive fountain for the anus-washing is provided to a position or part subjected to the aforesaid bidet-washing. As a result, there has been a fear of a person who undergoes the aforesaid washing feeling unpleasant.

SUMMARY OF THE INVENTION

Accordingly, one object of the present invention is to provide an improved washing device which can jet or spout a weaken fountain for the purpose of bidet-washing with reliability, while which can jet or spout an intensive fountain for the purpose of the anus-washing.

Another object of the present invention is to provide an improved washing device which has no fear that a person who undergoes the anus or bidet-washing feels unpleasant.

A further object of the present invention is to provide an improved washing device which has no disadvantages in the prior art.

The foregoing and other objects are effected by the invention, as is apparent from the following description and claims.

DETAILED DESCRIPTION OF THE INVENTION

Figures 1, 2:
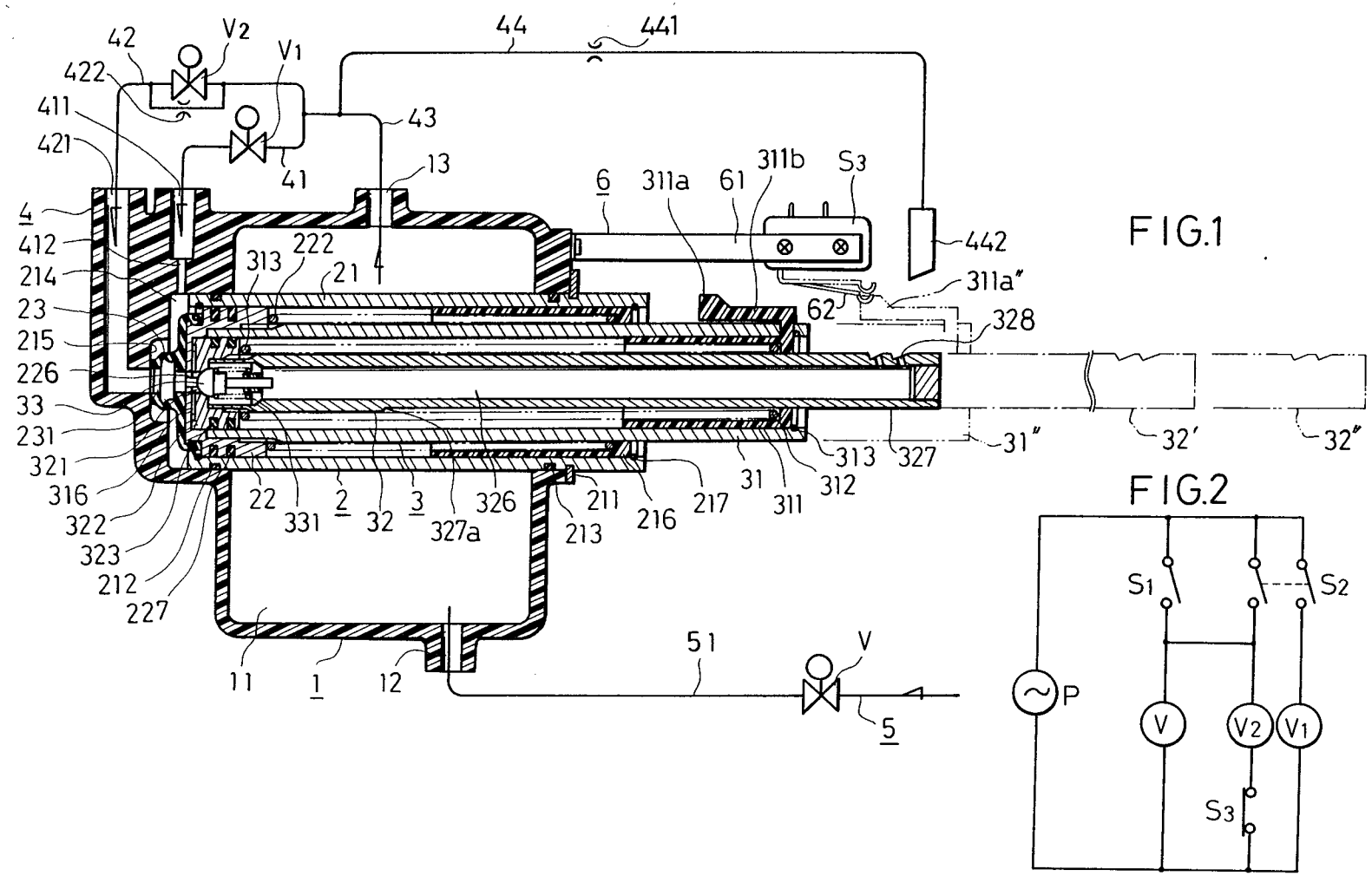
FIG. 1 is a sectional whole view illustrating essential parts of a washing device for parts of body according to a first embodiment of the present invention.
FIG. 2 is an electric circuit diagram used in the washing device of FIG. 1.

The present invention includes sensor means for detecting a front end position of a nozzle. Therefore, if the front end postion of the nozzle projects over a predetermined position, in accordance with an input signal generated from the aforesaid sensor means, supply of pressurized water which is to be a source of washing water, is controlled. Namely, the supply of pressurized water can be carried out through a supplying passage having large water supply resistance. Or otherwise, the rotation speed of pump means for supplying pressurized water is decreased to supply only a small amount of pressurized water.

One aspect of the present invention is directed to a washing device for parts of body which comprises:

(1) first cylinder means comprising a first cylinder and a first piston to be operated in the front end direction thereof by introducing pressurized water into the aforesaid first cylinder;

(2) second cylinder means comprising a second cylinder integrally connected to the aforesaid first piston and a second piston to be operated in the front end direction thereof by introducing pressurized water into the aforesaid second cylinder, said second piston being provided with at least one nozzle at a front end portion thereof to jet or spout pressurized water within a cylinder chamber formed in the second cylinder;

(3) pressurized water control means for selectively supplying pressurized water to both of the first and second cylinder, or to any one of them;

(4) pressurized water supply means for supplying pressurized water to the aforesaid pressurized water control means; the improvement wherein:

(a) the aforesaid washing device further comprises sensor means for sensing that any one of the aforesaid first and second pistons is operated over a predetermined operating position in the front end direction thereof;

(b) the aforesaid pressurized water control means is provided with a control member for controlling a supply amount of pressurized water and the aforesaid control member is operated based on an input signal applied to the sensor means thereby to supply a small amount of pressurized water.

The pressurized water control means, for example, may comprises a narrow supplying passage having a large water supply resistance; another side supplying passage having a small water supply resistance; and a solenoid valve disposed to the wide supplying pasage.

According to the aforesaid construction, when the front end of the second piston having the nozzle thereat is operated to project over a predetermined front position, the solenoid valve disposed to the wide supplying pipe is closed in accordance with an input signal applied to the sensor means so as to effect supply of pressurized water by only the narrow supplying pipe.

Or otherwise, there may be disposed a throttle valve at one of supplying pipes to throttle the throttle valve in accordance with an input signal applied to the sensor means, resulting in increase of water supply resistance in the supplying pipe. Thus, supply amount of water may be reduced.

In addition, other examples to increase water supply resistance in the supplying pipe, which has been known, may be adopted in the first aspect of this invention.

A second aspect of the present invetion is directed to the following washing device for parts of body.

In a washing device which comprises:

(1) first cylindr means comprising a first cylinder and a first piston to be operated in the front end direction thereof by introducing pressurized water into the aforesaid first cylinder;

(2) second cylinder means comprising a second cylinder integrally connected to the aforesaid first piston and a second piston to be operated in the front end direction thereof by introducing pressurized water into the aforesaid second cylinder, said second piston being provided with at least one nozzle at a front end portion thereof to jet or spout pressurized water within a cylinder chamber formed in the second cylinder;

(3) pressurized water control means for selectively supplying pressurized water to both of the first and second cylinder, or to any one of them; and (4) pressurized water supply means for supplying pressurized water to the aforesaid pressurized water control means; the improvement wherein:

(a) the washing device further comprises sensor means for sensing that any one of the aforesaid first and second piston is operated over a predetermined operating position in the front end direction thereof; and (b) the aforesaid pressurized water supply means comprises pump means the capacity of which is variable thereby to vary the capacity of pump means so as to be reduced based on an input signal in the aforesaid sensor means.

According to this second aspect of the present invention, supply capacity of pressurized water in a water pump is varied in accordance with an input signal applied to the sensor means, as descrived above.

As the pump means for varying supply capacity of pressurized water, for example, the following means may be used.

Namely, voltage of the motor for operating the pump is reduced or frequency thereof is decreased to lower number revolution of the motor, whereby the amount of water to be jetted or sputed by the pump is reduced.

In addition, other conventional pump means to reduce the amount of water to be jetted or spouted may be also employed for this purpose.

According to the aforesaid first and second aspects of the invention, a nozzle cylinder portion thereof comprises the first cylinder means and second cylinder means assembled to the first piston of the first cylinder means and jets or spouts washing water or fountain from the front end of the second piston in the second cylinder means.

As to supply of pressurized water to the first and second cylinders, there is no any particular limitation. If pressurized water can be selectively supplied so as to operate only any one of the first and second pistons, or so as to operate both of them, any supply means may be employed for this purpose.

In the meantime, some of these nozzle cylinders have already been known and put to practical use.

Hereinafter, the present invention will be explained in accordance with embodiments thereof with reference to the accompanying drawings.

EMBODIMENT 1

FIG. 1 illustrates a sectional whole view illustrating essential parts of an washing device of a first embodiment according to the present invention. FIG. 2 illustrates an electric circuit thereof. This first embodiment corresponds to the first aspect of the invention.

The washing device of this first embodiment comprises a water tank 1, a first cylinder means 2, a second cylinder means 3, a pressurized water control means 4, a pressurized water supply means 5 which utilizes hydraulic pressure of running ater and a sensor means 6, as main constructional elements. The first and second cylinder means construct a nozzle cylinder portion of the washing device and they are disposed in the water tank 1 so as to penetrate the wall thereof.

The water tank 1 is formed of a molded product of resin and it is provided with a tank chamber 11 therein, an inlet port 12 for pressurized water at the bottom thereof and an outlet port 13 at the upper end thereof. There is inserted into the water tank 1 a first cylinder 21 (which will be explained hereinafter) so as to penetrate the wall of the tank 1 and it is water-tightly held horizontally therein across the tank chamber 11. While, a part of the side wall of the water tank 1 which is positioned adjacent to the rear end of the first cylinder 21 (that is, positioned in the left side on FIG. 1) forms a rear end part of the first cylinder 21 and a part of the pressurized water control means 4. The pressurized water control means 4 will be explained hereinafter.

The first cylinder means 2 comprises mainly the first cylinder 21 and a first piston 22.

The first cylinder 21 has a cylindrical shape and is fixed to the side wall of the water tank 1 by means of a fixing means 211. And it is also sealed water-tightly by means of O-rings 212, 213. The rear end part of the first cylinder 21 is inserted into a circular cavity 214 with a central dent. The cavity 214 is formed in the side wall of the water tank 1 so as to extend from the tank chamber 11. This cavity 214 also defines a part of a cylinder chamber of the first cylinder 21. The bottom 215 of the central dent defines a sealing surface which will be explained hereinafter. An orifice 412 is opened to the side surface of the aforesaid cavity 214 and it is communicated with a first port 411 of a first hydraulic passage 41, which is integrally formed into the side wall of the water tank. While, there is also one open end of a second port 421 of a second hydraulic passage 42 to the center of the bottom 215 of the aforesaid cavity 214. The first hydraulic passage 41 is provided with a first solenoid valve V1, while the second hydraulic passage 42 is also provided with a second solenoid valve V2 and a throttle valve 422 are connected in parallel to each other. The first hydraulic passage 41 and second hydraulic passage 42 are respectively communicated with a third hydraulic passage 43 which is communicated with the outlet port 13 of the water tank 1. This third hydraulic passage 43 is also connected to an exhaust water passage 44 which is provided with another throttle valve 441. The exhaust water passage 44 is provided with a nozzle 442 at the downstream end thereof. By a jet water spouted from this nozzle 442, the outer peripheral surface of a second piston 32 is washed. The second piston 32 will be described hereinafter.

The first piston 22 has a bottomedcylindrical shape and it is provided with a small center through hole 226 at one end thereof but is opened at the other end thereof. The piston 22 is also provided with two cylindrical grooves at the outer peripheral surface thereof and rubber seals 227 are held therein, respectively. This first piston 22 is assembled within a first cyliner chamber formed in the first cylinder 21 in a slidable manner along the axial direction thereof. The first piston 22 is forced by a spring 222 towards the rear end thereof.

These are inserted in the first cylinder 21 a cylindrical spring seat 216 and a ring-shaped stopper member 217 at the front end thereof and fixed thereto. Between this spring seat 216 and the first piston 22, the aforesaid spring 222 is interposed in a compressed manner. At the rear end of the first piston 22, a sealing valve 23 made of rubber is fixed liquid-tightly. The rubber sealing valve has a hole 231 at the center thereof and it has also an annular projecting portion at one end thereof. The annular end surface of the sealing valve 23 surrounding the center hole 231 thereof is in contact with the bottom 215 of the cavity 214 so as to form an annular sealing surface thereto. As a result, an opening of the second port 421 and the central through hole 226 of the first piston 22 are connected to each other.

The second cylinder means 3 comprises a second cylinder 31 and a second piston 32. The second cylinder 31 has a cylindrical shape and the rear end thereof is coaxially fixed to the first piston 22.

The second piston 32 comprises a cylindrical rear end portion 322 having a central hole 321 therein and a pipe-shaped cylindrical portion 327 which is coaxially fixed to one end of the rear end portion 322. The cylinder portion 327 is provided with an axial hole therein and the front end thereof is closed. At the outer periphery of the aforesaid rear end portion 322, there are formed two annular grooves and rubber seals 323 are inserted thereinto, respectively. This second piston 32 is slidably assembled within a second cylinder chamber 316 of the second cylinder 31.

Between the front side end of the rear end portion 322 of the second piston 32 and a guide 311 inserted into the second cylinder 31 at the front end thereof, a spring 312 is interposed in a compressed manner so as to force the second piston 32 to the rear end direction thereof. This guide 311 is fixed by a guide fixing member 33 to the front end of the second cylinder 31.

In the cylinder portion 327 of the second piston 32, the outer peripheral wall at the lower side thereof is cut and removed therefrom by a predetermined distance from the front end thereof with a predetermined thickness. As a result, a stepped portion **327*a* is formed at the middle of the lower side of the cylinder portion 327**.

The guide 311 is provided with a through hole therein. The through hole thereof has the same sectional configuration as that of the front part of the cylinder portion 327 of the second piston 32, where the outer wall at the lower side thereof is partially removed as described above. Therefore, the cylinder portion 327 of the second piston 32 is slid along this through hole of the guide 311 without being rotated therein. The guide 311 is also provided wth an outer guide portion **311*b* at the front end thereof. The outer guide portion 311*b* projects from the outer periphery of the guide 311 and extends in the axial direction thereof. The outer guide portion 311*b* is provided with a projecting portion 311*a* at the rear end thereof. This projecting portion 311*a*** is associated with a limit switch S3, which will be described hereinafter, to press the limit switch S3.

On the other hand, there is assembled a constant-pressure valve 33 within the central hole 321 formed in the rear end portion 322 of the second piston 32. This constant-pressure valve 33 is normally forced in the rear end direction thereof by means of a spring 331.

In addition, the second piston 32 is further provided with at least one nozzle 328 composed of a small through hole at the peripheral wall of the upper side of the front end portion thereof.

The pressurized water supply means 5 comprises a hydraulic passage 51 which is connected to an water pipe and a solenoid valve V disposed to this hydraulic passage 51. The hydraulic passage 51 is also connected to the inlet port 12 of the water tank 1.

The sensor 6 comprises an arm 61 fixed to the upper side wall of the water tank 1 and a limit switch S3 fixed to the front end of the arm 61. The limit switch S3 is operated so as to effect ON-OFF control by means of a contact 62 which is disposed at the lower end thereof. This contact 62 is made in contact with the projecting portion **311*a* of the guide 311 fixed to the front end of the second piston 32** so as to be pushed upwardly.

An electric circuit for operating solenoid valves V, V1 and V2 of the washing device according to this first embodiment is illustrated in FIG. 2. In this electric circuit, each of the solenoid valves V, V1 and V2 is connected to a power source P in parallel to each other and a first switch S1 is provided between the solenoid valve V and the power source P. In addition, second switches S2, which serve as a gang switch, are provided between the power source P and the solenoid valve V1, and between the power source P and valve V2, respectively. Furthermore, a conductor connecting the solenoid valve V and switch S1 is combined electrically with another conductor connecting the solenoid valve V2 and the switch S2, and a limit switch S3 is also provided between the solenoid valve V2 and the power source P.

The washing device according to this first embodiment was constructed as described above.

Next, the operation of this washing device will be explained.

The state of this washing device before used is shown in FIG. 1, while the wirings and switches of the electric circuit are as shown in FIG. 2.

First, the case, in which the washing device is used for the anus-washing, will be explained.

When the first switch S1 is cloed (ON), electric currents are supplied from the power source P to the solenoid valves V and V2, respectively. In this case, since the limit switch S3 is composed of a normally closed contact. The first piston 22 continues to be forced to the rear end position thereof as shown in FIG. 1, before the washing device is operated. And therefore, the limit switch S3 is in ON-condition. And then, when the solenoid valve V is supplied with a current, it is opened so that running water is supplied to the pressurized water supply passage 51 through a water pipe (not shown). As a result, pressurized water enters into the tank chamber 11 through the inlet port 12 of the tank 1 and then it is carried to the hydraulic passage 43 through the outlet port 13 thereof. In this case, since the solenoid valve V1 is not supplied with a current, it is closed. Therefore, the pressurized water enters into a second port 421 through the solenoid valve V2 of the second hydraulic passage 42 and then it passes through the central hole 231 of the seal valve 23. And the pressurized water further passes through the central through hole 226 of the first piston 22 to enter into the second cylinder chamber 316. In this case, however, since the seal valve 23 is interposed between the opening of the second port 421 and the cavity 214 which defines the first cylinder chamber to seal therebetween, the pressurized water from the second port 421 does not enter into the first cylinder chamber including the cavity 214 therein. The second piston 32 is pressed or pushed in the front end direction thereof (i.e., in the right direction of FIG. 1) by means of hydraulic pressure of the pressurized water entered into the second cylinder chamber 316. The cylinder portion 327 of this second piston 32 is guided by the guide 311 to be operated in the front end direction thereof with the opening end of the nozzle 328 being in upward. And then, the stepped portion 327*a* of the cylinder portion 327 is made in contact with the front end of the guide 311 thereby to stop the operation of the second piston 32. As a result, hydraulic pressure within the second cylinder chamber 316 is increased and it overcomes pushing force of the spring 331 of the constant-pressure valve 33 to open the constant-pressure valve 33. Consequently, the pressurized water in the second cylinder chamber 316 enters into the axial hole 326 of the cylinder portion 327 of the second piston 32. The pressurized water entered into the axial hole 326 is jetted from the nozzle 328. At this time, the front end position of the second piston 32 is as shown by an alternate long and short dash line 32' in FIG. 1.

Since this second hydraulic passage 42 is provided with no portion having water supply resistance, such as orifice or the like, in the second port 421 thereof, a relatively large amount of pressurized water enters into the second cylinder chamber 316. And therefore, a relatively large amount of intensive fountain is jetted or spouted from the nozzle 328, thereby to effect the anus-washing.

In the meantime, a part of the pressurized water from the hydraulic passage 43 passes through a throttle valve 441 of the exhaust passage 44 to be jetted from the nozzle 442 of the exhaust passage 44. The jet of water from this nozzle 442 is spouted to the outer peripheral surface of the cylinder portion 327 of the second piston 32 to wash the outer peripheral surface of the second piston 32. Under the aforesaid condition, if the first switch S1 is opened (OFF), the solenoid valves V, V2 are closed so that supply of pressurized water from the water pipe is stopped by the solenoid valve V. As a result, water in the second cylinder chamber 316 is pushed back in the rear end direction thereof (in the left direction on FIG. 1) by means of the spring 313 for forcing the second piston 32. This water in the second cylinder chamber 316 is fed back through the central hole 231 disposed in the seal valve 23 and also through the second port 421 connected thereto. Furthermore, it passes through the throttle valve 422 disposed in parallel with the solenoid valve V2 and through the throttle valve 441 of the exhaust passage 44 thereby to be exhausted from the nozzle 442. Consequently, the second piston 32 is returned in the initial state as illustrated in FIG. 1.

Next, the bidet-washing operation of the washing device will be explained.

When the second switch S2 is closed (ON), all of the solenoid valves V, V1, V2 are opened so that pressurized water from the water pipe passes through the solenoid valve V, the pressurized water supply passage 51 and the water tank chamber 11. And it further passes through the hydraulic passage 43, solenoid valves V1, V2 and the first and second ports 411, 421 and further through the cavity 214, central through hole 226 disposed in the first piston 22. Consequently, it enters into the second cylinder chamber 316 of the second cylinder 31. As a result, the first piston 22 is forced in the front end direction thereof (in the right direction on FIG. 1) by means of hydraulic pressure within the cavity 214. At the same time, the second piston 32 is also forced by hydraulic pressure of the pressurized water in the second cylinder chamber 316 thereby to be pushed in the front end direction thereof.

On the other hand, when the first piston 22 is pushed in the front end direction, the sealing surface defined between the annular top end portion of the seal valve 23 and the bottom 215 of the cavity 214 is released, whereby the water in the second port 421 enters into the cavity 214 and then joints with pressurized water supplied from the first port 411 therein.

Under the aforesaid condition, when pressurized water enters into the first cylinder chamber including the cavity 214, the first piston 22 is moved in the front end direction thereof so that the projecting portion 311*a* of the guide 311 fixed to the front end of the second cylinder 31 reaches a position of 311*a*" as illustrated by alternate long and two short dashes line in FIG. 1. By this projecting portion 311*a*", the contact 62 of the limit switch S3 is pushed to open the normally closed contact of the limit switch S3 in order to make it OFF condition, whereby supply of a current to the solenoid valve V2 is stopped to close the solenoid valve V2. As a result, pressurized warer to be supplied into the first cylinder chamber is limited to only pressurized water supplied from the first hydraulic passage 41.

In the meantime, since there is formed the orifice 412 between the first port 411 of the first hydraulic passage 41 and the cavity 214, a relatively small amount of pressurized water is fed into the cavity 214 because of water supply resistance of this orifice 412. And then, the second piston 32 is further moved in the front end direction thereof by means of pressurized water supplied passing through the aforesaid first hydraulic passage 41, so that the stepped portion 327*a* of the cylinder portion 327 thereof is made in contact with the front end portion of the guide 311 thereby to stop the movement of the second piston 32. At this time, the second piston 32 reaches a position as shown by a numeral 32" in FIG. 1. Under the aforesaid condition, pressurized water is further supplied the cavity 214 passing through the first hydraulic passage 41 so that hydralic pressure of the pressurized water thus supplied overcome the force of the spring 331 of the constantpressure valve 33. And therefore, the pressurized water in the second cylinder chamber 316 enters into the axial hole 326 formed in the cylinder portion 327 of the second piston 32 to be jetted or spouted from the nozzle 328 disposed at the front end portion thereof as a fountain for the bidet-washing. In this case, since the amount of pressurized water supplied from the first hydraulic passage 41 is relatively small, the amount of fountain spouted from the nozzle 328 is also relatively small. And therefore, a fountain suitable for the bidet-washing can be provided.

On the other hand, in the washing device according to this embodiment, even if a switch for the first switch S1 is pressed by error under the aforesaid condition of the fountain for bidet-washing being provided, the solenoid valve V2 is not opened so as to continue the closed condition, because the limit switch S3 is in an open condition (OFF condition). Therefore, supply of pressurized water is effected by only the first hydraulic passage 41 through the solenoid valve V1. Since the passage 41 is provided with the orifice 412 therein, a relatively small amount of pressurized water can be supplied. Accordingly, there is no fear that a relatively large amount of fountain for the anus-washing is provided in the aforesaid case.

Thus, even if a switch for the anus-washing is pressed by error to be turned "ON" under the condition of the washing device being in the bidet-washing, such a relatively large amount of fountain, is not spouted, as to be provided for the anus-washing.

Accordingly, there is no fear that a person who undergoes the aforesaid anus-washing or bidet-washing feels unpleasant for this purpose.

Then, when the first and second switches S1, S2 are opened, all of the solenoid valves V, V1, V2 are closed and then water within the first cylinder chamber and the second cylinder chamber 316 is forced by the respective first and second pistons 22, 32 in the rear end direction thereof. Further, the water is fed back through the second port 421 and the throttle valve 422 and passes through the throttle valve 441 of the exhaust passage 44 to be exhausted from the nozzle 442. As a result, the first and second pistons 22, 32 are moved in the rear end direction thereof so as to be returned in the initial condition thereof as shown in FIG. 1.

EMBODIMENT 2

Hereinafter, a second embodiment according to the present invention will be explained.

Figures 3, 4:
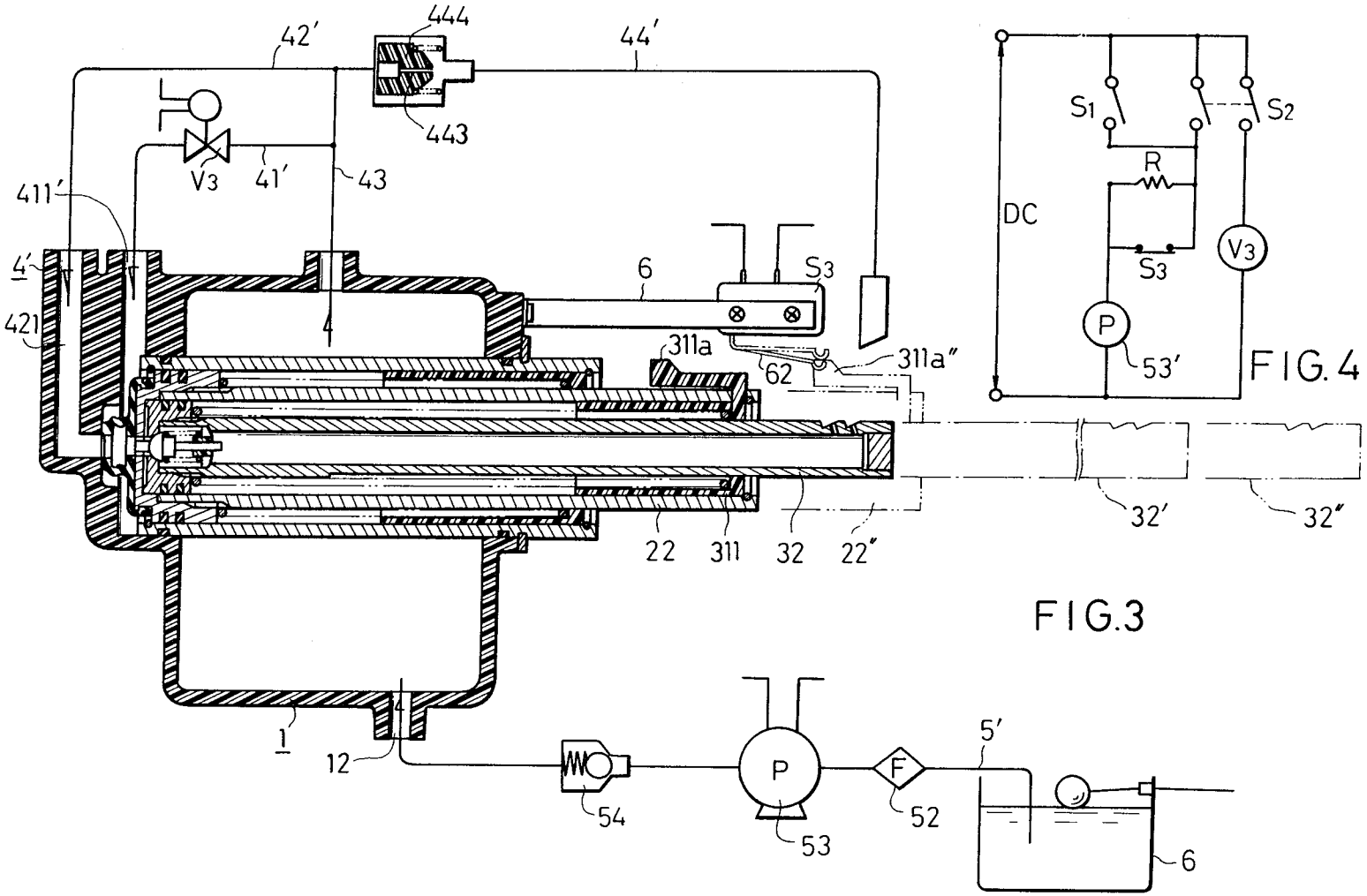
FIG. 3 is a sectional whole view illustrating essential parts of a washing device for parts of body according to a second embodiment of the present invention.
FIG. 4 is an electric circuit diagram used in the washing device of FIG. 2.

A washing device according to this second embodiment is shown in FIG. 3 and wherein essential parts of this device are illustrated in a cut-away sectional view. And an electric circuit used in the aforesaid device is shown in FIG. 4.

The aforesaid device of this embodiment corresponds to one example of the second aspect of the invention.

In this device, a water tank 1 and nozzle cylinder part thereof are almost the same as in the first embodiment. Therefore, in this second embodiment, different parts from those of the first embodiment will by mainly explained.

According to the washing device of this embodiment, a pressurized water control system 4' is adopted for the pressurized water control means of the present invention, which system 41 is provided with no orifice 412 as shown in FIG. 1 in a first port 411' thereof. In addition, a first hydraulic passage 41' is only provided with a solenoid valve designated by V3. A second hydraulic passage 42' connects the hydraulic passage 43 and the second port 421. Further, an exhaust passage 44' is provided with a constant-pressure valve 444 having an orifice 443 therein.

In a pressurized water supply device 5' adopted for the pressurized water supply means of this invention, water is supplied to the inlet port 12 of the tank 1 from a water tank 6 for toilet or the like through a filter 52, a pump 53 and a uni-directional valve 54. In this case, the pump 53 is actuated by a D.C. motor not shown.

The electric circuit for the aforesaid device is illustrated in FIG. 4. In this circuit, a motor 53 for the pump and an electromagnetic valve V3 as the solenoid valve are connected parallel to each other and they are also connected in parallel to a D.C. source. Further, there are disposed a first switch S1 betwen the D.C. source and pump motor 53, and a second switch S2 between the D.C. source and the electro-magnetic valve V3. In this case, the second switch S2 is composed of a gang switch. And, a resistor R and a limit switch S3 are also disposed between the first switch S1 and the pump motor 53 in parallel to one another. In addition, fixed terminals for the first switch S1 and other fixed terminals for the second switch S2, which are interconnected with one another for a gang switch, are connected to one another.

The washing device according to this second embodiment has the aforesaid construction.

According to the aforesaid washing device of the second embodiment, the projecting portion 311*a* of the guide 311, which is supported at the front end of the second cylinder 31, is made in contact with the contact 62 of the limit swich S3 so that the limit switch S3 is opened to supply a current to the motor 53 of the pump through the resistor R. Therefore, an input voltage applied to the motor 53 is reduced to a low voltage by means of the resistor R, so that number of revolution of the pump motor 53 is lowered. Further, the amount of pressurized water, which is to be operated and supplied by the pump motor 53, is also reduced. As a result, when the first piston 22 is pushed in the front end direction thereof and the limit switch S3 is opened by means of the projecting portion 31*a*" of the guide 311, the amount of pressurized water to be supplied to the first and second cylinder chambers is relatively small and therefore, the amount of water jetted from the nozzle 328 is also small. Thus, a fountain or a jet of water having a relaively small amount is provided to effect the bidet-washing.

Accordingly, even if the switch S1 for the anus-washing is closed (ON) by error under the condition of the switch S2 for the bidet-washing being in ON condition, a relatively large amount of fountain having intensive flow, as used for the anus-washing, is not spouted, as long as the first piston 22 is in the bidet-washing position. Therefore, there is no fear that a person who undergoes the aforesaid washing feels unpleasant.

In this embodiment, a D.C. source has been employed but an A.C. source may be also employed if only an alternate motor is used for this purpose.

What is claimed is new and intended to be covered by Letters Patent is:

1. In a washing device for parts of body which comprises:

(1) first cylinder means comprising a first cylinder and a first piston to be operated in the front end direction thereof by introducing pressurized water into said first cylinder;

(2) second cylinder means comprising a second cylinder integrally connected to said first piston and a second piston to be operated in the front end direction thereof by introducing pressurized water into said second cylinder, said second piston being provided with at least one nozzle at the front end thereof to jet or spout pressurized water for washing parts of the body from a cylinder chamber formed in the second piston;

(3) pressurized water control means for selectively supplying pressurized water to both of said first and second cylinders, or to any one of them; and (4) pressurized water supply means for supplying pressurized water to said pressurized water control means; the improvement wherein:

said second cylinder means is telescopically disposed within said first cylinder means; and said pressurized water supply means comprises:

(a) means for selectively causing said pressurized water control means to supply pressurized water to said second cylinder means to extend said nozzle of said second piston to a first washing position;

(b) means for selectively causing said pressurized water control means to supply pressurized water to both of said first and second cylinder means to extend said nozzle of said second piston to a second washing position;

(c) sensor means for detecting extension of one of said first and second cylinders to a given position; and (d) means responsive to said sensor means for reducing said water supply to said first and second cylinder means upon said detection of said extension.

2. A washing device as claimed in claim 1, wherein:

said pressurized water control means comprises first and second supplying passages for receiving water from said pressurized water supply means, said second supplying passage having a lower effective resistance to water flow than that of said first supplying passage, and said means responsive to said sensor means comprises a valve in fluid communication with said second supplying passage and means for closing said valve based upon a change of state of said sensor means.

3. A washing device as claimed in claim 1, wherein:

said pressurized water supply means comprises variable capacity pump means, and said means responsive to said sensor means comprises means for reducing the pumping rate of said pump means based upon a change of state of said sensor means.

* * * * *